United States Patent [19]

Yoritomi

[11] 4,436,476

[45] Mar. 13, 1984

[54] ROD DEVICE FOR USE AS AN ARM OF AN EXCAVATOR

[76] Inventor: Ryutaro Yoritomi, 5-17-12, Koishikawa, Bunkyo-ku, Tokyo, Japan

[21] Appl. No.: 327,911

[22] Filed: Dec. 7, 1981

Related U.S. Application Data

[63] Continuation of Ser. No. 90,325, Nov. 1, 1979, abandoned.

[30] Foreign Application Priority Data

| | | | |
|---|---|---|---|
| Nov. 24, 1978 | [JP] | Japan | 53-145033 |
| Feb. 10, 1979 | [JP] | Japan | 54-014601 |
| May 14, 1979 | [JP] | Japan | 54-058773 |

[51] Int. Cl.[3] ..... E02F 5/22

[52] U.S. Cl. ..... 414/690; 414/694; 414/718; 414/722; 212/149; 212/230; 212/267

[58] Field of Search ..... 175/238; 414/673, 618, 414/624–626, 631, 690, 718, 694, 738, 722, 728; 212/149, 150, 155, 230, 244, 251, 183 R, 186, 187, 189, 266–268; 37/183 R, 186, 187

[56] References Cited

U.S. PATENT DOCUMENTS

| | | | |
|---|---|---|---|
| 796,842 | 8/1905 | Hoffmann et al. | 414/673 X |
| 850,356 | 4/1907 | Desy | 414/625 |
| 1,162,740 | 12/1915 | Bathrick | 414/625 |
| 2,509,686 | 5/1950 | Huston | 212/222 |
| 2,594,720 | 4/1952 | Beck, Jr. . | |
| 2,904,197 | 9/1959 | Asheim et al. | 414/663 |
| 3,126,115 | 3/1964 | Schuff | 414/624 |
| 3,199,685 | 8/1965 | Bopp | 212/151 |
| 3,219,212 | 11/1965 | Billings | 37/183 R |
| 3,307,713 | 3/1967 | Bopp | 212/268 |
| 3,329,291 | 7/1967 | Przybylski | 414/718 |
| 3,445,015 | 5/1969 | Sampo et al. | 414/718 X |
| 3,624,785 | 11/1971 | Wilson | 414/718 X |

FOREIGN PATENT DOCUMENTS

| | | | |
|---|---|---|---|
| 816601 | 4/1937 | France | 37/186 |

*Primary Examiner*—Robert J. Spar
*Assistant Examiner*—Terrance L. Siemens
*Attorney, Agent, or Firm*—Birch, Stewart, Kolasch & Birch

[57] ABSTRACT

A rod device for use as an arm of an excavator, so as to be pivotally supported by a boom and inclined relative to the boom by an actuator, including a plurality of tubular elements assembled in a telescoping manner, means for restricting relative axial movement of each two mutually telescoping tubular elements, and a means for drivingly connecting the outermost and the innermost of the plurality of telescoping tubular elements, wherein a clamshell bucket or a rock breaker is directly mounted to the tip end of the rod device so that the rod device serves both as an arm and a cable for suspending the clamshell bucket or the rock breaker.

9 Claims, 25 Drawing Figures

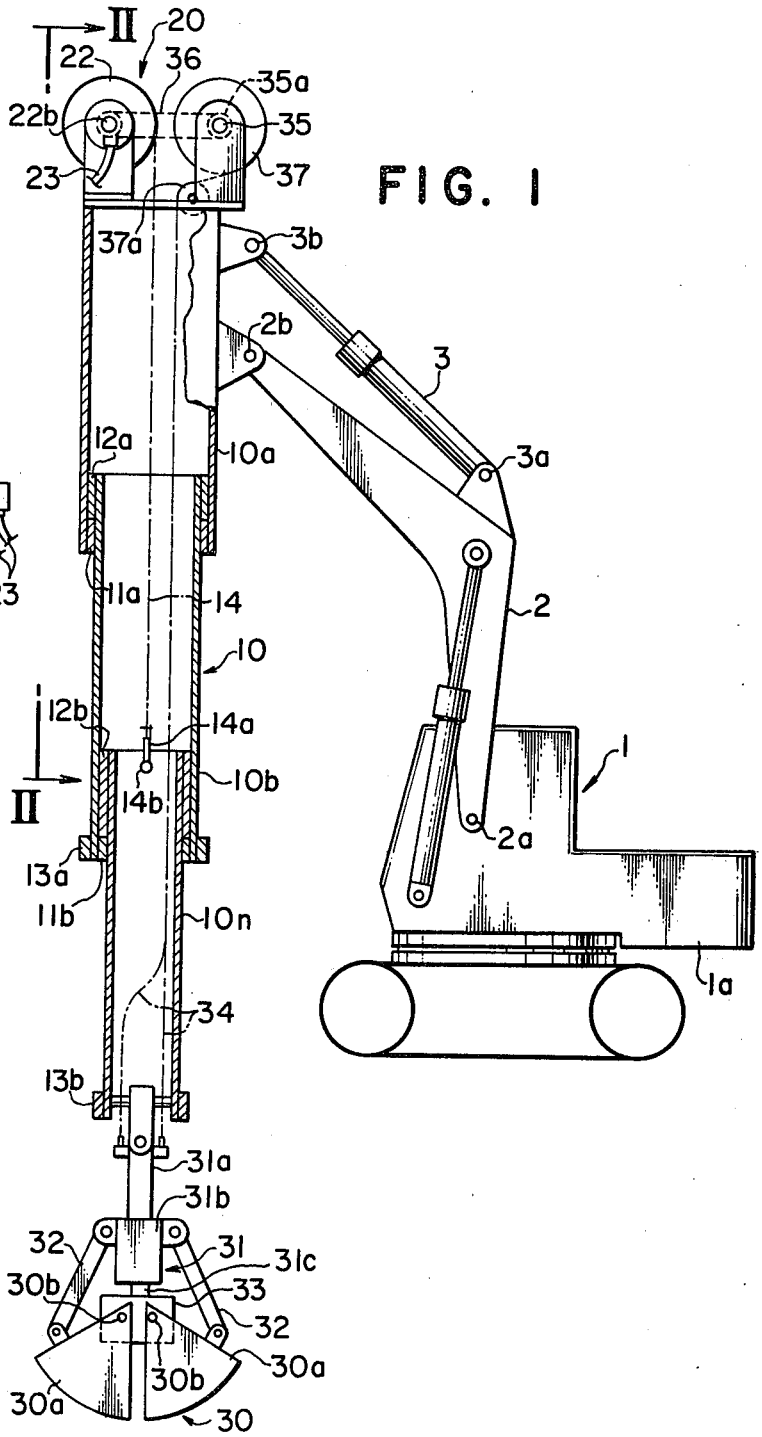
FIG. 1
FIG. 2
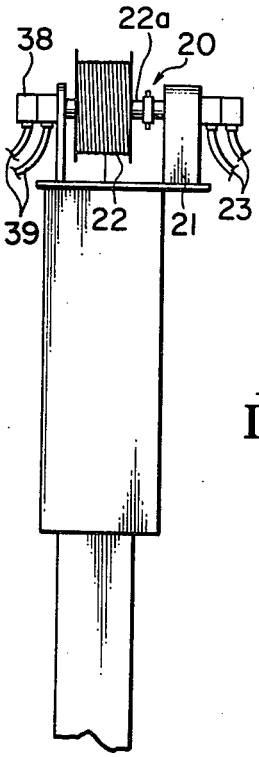

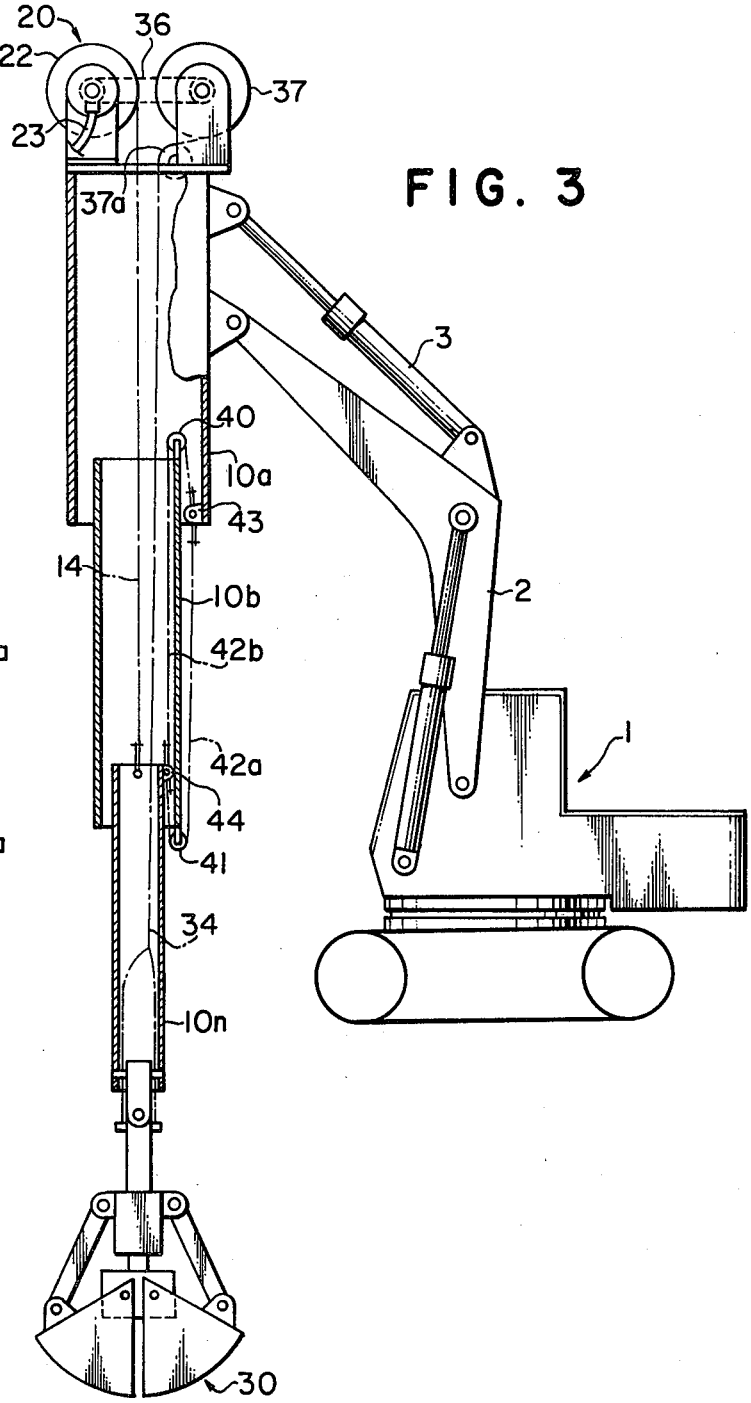
FIG. 3
FIG. 4
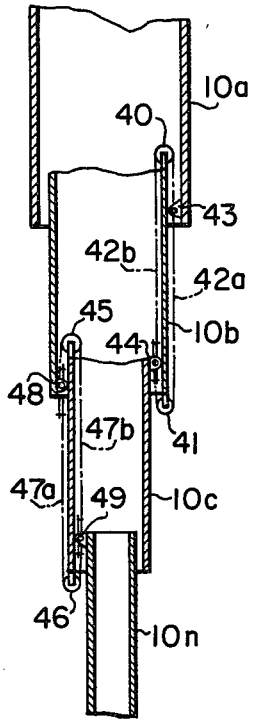

ROD DEVICE FOR USE AS AN ARM OF AN EXCAVATOR

This application is a continuation of copending application Ser. No. 090,325, filed on Nov. 1, 1979 now abandoned.

BACKGROUND OF THE INVENTION

The present invention relates generally to construction machinery, particularly to an excavator, and more particularly to a rod device for use as an arm of the excavator.

A known kind of excavator is a power shovel, which generally has a base structure generally formed as a caterpillar tractor, a boom pivotally supported at its lower end by the base structure, a means for changing inclination of the boom relative to the base structure, an arm pivotally supported near its root end by the upper end of the boom, an actuator mounted between an intermediate portion of the boom and the root end of the arm for changing inclination of the arm relative to the boom, and an excavating head such as a hoe mounted at the tip end of the arm. A power shovel of this kind can excavate only relatively shallow holes in the ground. In order to excavate relatively deep holes in the ground, it is known to remodel an excavator of the abovementioned structure so as to remove the hoe from the tip end of the arm, and instead to mount a clamshell bucket as suspended from the tip end of the arm by way of a cable adapted to be paid out from or wound up to the tip end of the arm. In this case, theoretically, a hole of any large depth can be excavated, by increasing the length of the cable. However, in the actual operation, as the cable becomes longer, the suspension of the clamshell bucket becomes more unstable, so as to cause larger swaying of the clamshell bucket, thereby requiring greater effort and longer time for the operator to place the clamshell bucket correctly at the position were excavation is to be done or at the position where the excavated material is to be dumped.

SUMMARY OF THE INVENTION

It is therefore the object of the present invention to provide an improved excavating machine which can excavate a relatively deep hole in the ground at high speed by virtue of the feature of an excavating head such as a clamshell bucket which may quickly and easily placed at the desired position for excavation or dumping in spite of a relatively large length of suspension of the excavating head.

In accordance with the present invention, the abovementioned object is accomplished by a rod device for use as an arm of an excavator having a boom and an actuator, said arm being pivotally supported by said boom and pivoted relative to said boom by said actuator, comprising: a plurality of tubular elements assembled in a telescoping manner; a means for restricting relative axial movement of each two mutually telescoping tubular elements; a cable which drivingly connects the outermost and the innermost of said plurality of telescoping tubular elements; a means provided on the outermost tubular element for pivotally connecting it to said boom and to said actuator; the innermost tubular element being adapted to support an excavating head such as a clamshell bucket or a rock breaker at its tip end.

When a rod device of the abovementioned structure is used as supported, like an arm, by a boom and an actuator of a conventional machine, such as a power shovel, with an excavating head such as a clamshell bucket mounted to the tip end of the rod device, it operates not only as a conventional arm which determines the desired plan position of the excavating head suspended from it but also as a cable in the conventional cable suspension type excavator, which, however, is relatively stiff, so that it prevents swaying of the excavating head and further it can exert transverse force to the excavating head so as positively to bring it to the desired plan position, in addition to its inherent operation of suspending the excavating head in a manner of selectively descending or ascending it. In this case, therefore, positioning of the excavating had as planned is very easily and quickly attained by coordinated operations of a boom inclination changing means, an actuator for changing inclination of the arm, i.e., the rod device, relative to the boom, and a base structure turning means.

The rod device of the present invention can be designed so as temporarily or permanently to replace the arm of an existing power shovel or other similar excavating machine, and therefore it may be manufactured and sold as an independent product.

BRIEF DESCRIPTION OF THE DRAWINGS

The present invention will become more fully understood from the detailed description of several embodiments given hereinbelow, and the accompanying drawings, which are given by way of illustration only, and thus are not limitative of the present invention, and wherein:

FIG. 1 is a diagrammatical view, with part of it shown in section, of an embodiment of the rod device of the present invention, supporting a clamshell bucket and supported by the base structure of an excavator;

FIG. 2 is a partial side view of the rod device shown in FIG. 1, seen in the direction of arrows II—II;

FIG. 3 is a view similar to FIG. 1, showing another embodiment of the present invention;

FIG. 4 is a diagrammatical sectional view of a part of still another embodiment of the rod device of the present invention;

DESCRIPTION OF THE PREFERRED EMBODIMENTS

Figure 6:
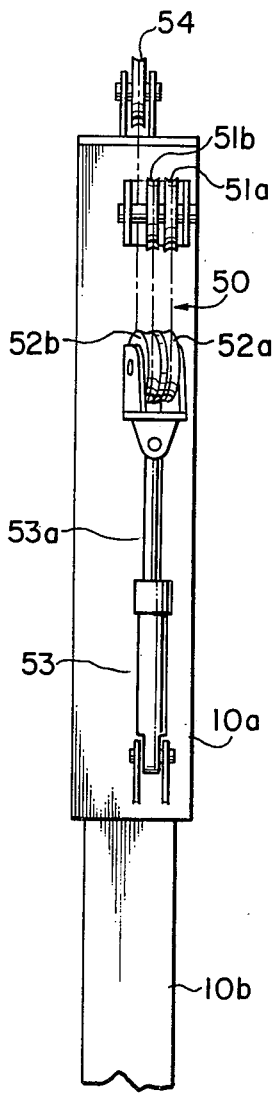
FIG. 6 is a side view of the device shown in FIG. 5, seen in the direction of arrows VI—VI.

Referring first to FIGS. 1 and 2, showing the first embodiment of the present invention, 10 generally designates the rod device of the present invention which is used as an arm of an excavator 1 having a base structure 1*a* constructed as a caterpillar tractor, a boom 2 pivotally supported at its lower end 2*a* by the base structure 1*a*, and an actuator 3 pivotally supported at its lower end 3*a* by a middle portion of the boom 2, wherein the arm, i.e. the rod device 10, is pivotally connected with the upper ends 2*b* and 3*b* of the boom and the actuator so as to be pivotally supported by the boom and pivoted relative to the boom by the actuator.

The rod device 10 is substantially composed of a plurality of tubular elements 10*a*, 10*b*, . . . 10*n*. The embodiment shown in FIGS. 1 and 2 includes only three tubular elements. It is generally desirable that the tubular elements should have square or rectangular cross sections. At the inside of the tubular element 10*a*, adjacent to its tip end, is mounted a stop 11*a*, which, in this embodiment, is a looped element slidably engaged around the outside surface of the tubular element 10*b* inserted into the tubular element 10*a*. On the other hand, at the outside of the tubular element 10*b*, adjacent to its root end, is mounted a stop 12*a*, which, in this embodiment, is also a looped element slidably engaged with the inside surface of the tubular element 10*a*. These two stops 11*a* and 12*a* cooperate with each other so as to restrict relative axial movement of the two mutually telescoping tubular elements 10*a* and 10*b* in the direction of expanding the rod device 10. Further, at the outside of the tubular element 10*b*, adjacent to its tip end, is mounted a stop 13*a*, which, in this embodiment, is also a looped element. The stop 13*a* cooperates with the stop 11*a*, so as to restrict relative axial movement of the two mutually telescoping tubular elements 10*a* and 10*b* in the direction of contracting the rod device 10. Similarly, the relative axial movement between the mutually telescoping tubular elements 10*b* and 10*n* in the direction of expanding the rod device 10 is restricted by the cooperation of stops 11*b* and 12*b* mounted at the inside of the tip end of the tubular element 10*b* and at the outside of the root end of the tubular element 10*n*, respectively, while the relative axial movement between the tubular elements 10*b* and 10*n* in the direction of contracting the rod device is restricted by the cooperation of the stop 11*b* and a stop 13*b* which is mounted at the outside of the tip end of the tubular element 10*n*. The stops 11*b*, 12*b*, and 13*b* are also looped elements. However, it is not essential that these stops are looped elements, but they may be divided into several elements arranged along the outer or the inner peripheral surface of the tubular element.

The outermost tubular element 10*a* and the innermost tubular element 10*n* are drivingly connected by a cable 14 arranged in the central bore of the rod device 10. The tip end 14*a* of the cable is mounted to a hole 14*b* formed at the root end of the tubular element 10*n*, while the root end portion of the cable is supported by a winch 20 mounted at the root end of the tubular element 10*a*. The winch 20 includes a drum 22 for winding up the root end portion of the cable, which is driven by an oil pressure motor 21 in accordance with supply of oil pressure, via hoses 23.

As a modification, however, the winch 20 may be mounted in another spot, such as the body of the base structure 1, while only a pulley is mounted at the root end portion of the tubular element 10*a*, said pulley guiding the cable 14 extended through the central bore of the rod device 10 towards the winch mounted in said other place from the root end position of the tubular element 10*a*.

Further, as still another modification, the cable 14 may be mounted along the outside surface of the telescoping tubular elements so that the tip end of the cable is mounted to the tip end of the tubular element 10*n*, while the root end portion of the cable is supported either directly by the winch 20 mounted at the root end of the tubular element 10*a*, or indirectly by the winch mounted in another spot, such as the body of the base structure, by way of a pulley mounted at the root end of the tubular element 10*a*.

The tip end of the innermost tubular element 10*n* supports a clamshell bucket generally designated by 30. The clamshell bucket 30 is of an oil hydraulic type which includes a cylinder-piston assembly 31 including a cylinder 31*b* formed as a part of a suspension frame 31*a* and a piston rod 31*c* connected with a piston not shown in the figure and incorporated in the cylinder 31*b*. The piston rod 31*c* supports a bearing element 33, to which are pivotally mounted a pair of buckets 30*a* by pivot pins 30*b*. The buckets 30*a* are further connected with the cylinder 31*b* by a pair of link elements 32, each of which is pivotally connected at the opposite ends to the buckets and the cylinder. The suspension frame 31*a* is mounted at the tip end of the tubular element 10*n*. The cylinder-piston assembly 31 is actuated by oil pressure supplied through a pair of hoses 34, which are connected at their tip ends to the suspension frame 31*a* in which oil passages are provided, and are wound round a hose drum 37 at their root end portions. The root terminal ends of the hoses 34 are connected through two oil passages (not shown in the figure) provided in a shaft 35 which supports the cable drum 37, and are connected with a pair of hoses 39 by way of a rotatable fluid connection 38, which itself is well known in the art. The rotary shaft 22*a* for the cable drum 22 and the rotary shaft 35 for the hose drum 37 are drivingly connected by a driving system including sprocket wheels 22*b* and 35*a* and an endless chain 36, so that the hose drum 37 is driven simultaneously with the cable drum 22 when the latter is driven by the oil pressure motor 21 so as to pay out or wind up the hoses 34 in accordance with expansion or contraction of the rod device 10. Member 37*a* is a guide roller for the hoses 34.

When a hole is to be excavated in the ground, the base structure 1 such as a caterpillar tractor is properly operated so that the rod device 10 supported by its boom 2 and actuator 3 is positioned perpendicularly above the hole to be excavated with its tip end supporting the clamshell bucket 30 directed perpendicularly downward. In the initial stage, the oil pressure motor 21 is operated so as to wind up the cable 14, thereby contracting the rod device to a proper small length, for the convenience of operation of the rod device, and then, the motor 21 is operated in the reverse direction so as to pay out the cable 14 and to expand the rod device 10 under the action of gravity, thereby lowering the clamshell bucket 30 to the place for excavation. In this process, since a rod device 10 which suspends the clamshell bucket 30 is substantially rigid, no swinging of the clamshell bucket 30 occurs as in the conventional excavating device where the clamshell bucket is suspended by a cable. Further, although it is intended that the rod device 10 carries a load or the weight of it principally along its central axis, since it has some stiffness against bending moment exerted to it, it is possible for the rod device to support a substantial weight in a posture somewhat inclined from the perpendicularity, and therefore, positioning of the clamshell bucket 30 to the correct excavating or dumping position can be effected not only by positioning of the tip end of the boom 2 but also by operation of the actuator 3 so as to turn the rod device 10 around its pivoting position to the boom 2. This turning operation of the rod device relative to the boom makes it easier and quicker to place the clamshell bucket 30 at the desired excavating or dumping position.

The use of the rod device of the present invention for suspending a clamshell bucket as a substitute for the conventional cable provides another advantage that the buckets of the clamshell bucket 30 are more deeply driven into the ground by the weight of the rod device, or more correctly, in the embodiment shown in FIGS. 1 and 2, by the weight of the innermost tubular element 10*n*.

After the clamshell bucket has been placed and driven into the ground with its buckets held in their open position by the cylinder-piston assembly 31 being operated in one direction, the cylinder-piston assembly is then operated in the reverse direction so as to close the buckets, and the rod device 10 is contracted by winding up the cable 14 onto the drum 22 by energizing the oil pressure motor 21. Thereafter the rod device is further moved upward so that the clamshell bucket is taken out from the hole by operating the boom 2 and/or the actuator 3, and is moved sideward by the upper structure of the caterpillar tractor being rotated relative to its lower structure, and/or by the boom 2 being turned around its bottom pivoting axis, and/or some combination of these operations, or the rod device may be inclined by the actuator 3 being actuated. In any event, by one or some combinations of these operations, the clamshell bucket 30 can be quickly and easily brought to the place where the excavated material is dumped.

FIG. 3 is a view similar to FIG. 1, showing another embodiment of the present invention. In this embodiment, relative axial movement between the two mutually telescoping tubular elements 10*a* and 10*b* is restricted by pulleys 40 and 41 mounted at the opposite ends of the tubular element 10*b* and cables 42*a* and 42*b* engaged around these two pulleys 40 and 41, the cables being connected at their opposite ends with a tip end portion 43 of the tubular element 10*a* and a root end portion 44 of the tubular element 10*n*. By this arrangement, the tip end portion 43 of the tubular element 10*a* and the root end portion 44 of the tubular element 10*n* can move relative to the tubular element 10*b* only within the range between the two pulleys 40 and 41, simultaneously by the same amount in opposite directions to each other. By this arrangement, in the expansion or contraction of the rod device 10 due to paying out or winding up of the cable 14 by the cable drum 22, the engagement depth between each two mutually telescoping tubular elements is reduced or increased by the same amount with respect to all telescoping portions. This operation is very advantageous in view of maintaining balanced stiffness of the rod device over its entire length in all expanded or contracted conditions.

In FIG. 3, all other portions corresponding to those shown in FIG. 1 are designated by the same reference numerals.

FIG. 4 shows another embodiment similar to that shown in FIG. 3, which includes four telescoping tubular elements 10*a*, 10*b*, 10*c*, and 10*n*. In this case, relative movement between the tubular elements 10*a*, 10*b*, and 10*c* is controlled by two pulleys 40, 41 mounted to the tubular element 10*b* and cables 42*a* and 42*b* engaged around the two pulleys 40 and 41 and connected at their opposite ends to a tip end portion 43 of the tubular element 10*a* and a root end portion 44 of the tubular element 10*c*. On the other hand, relative movement between the tubular elements 10*b*, 10*c*, and 10*n* is controlled by two pulleys 45 and 46 mounted at opposite ends of the tubular element 10*c* and cables 47*a* and 47*b* engaged around the two pulleys 45 and 46 and connected at their opposite ends to a tip end portion 48 of the tubular element 10*b* and a root end portion 49 of the tubular element 10*n*. By these two relative axial movement restricting means incorporated individually between the tubular elements 10*a*, 10*b*, and 10*c* and between 10*b*, 10*c*, and 10*n*, in expansion and contraction the engagement depth between each two mutually telescoping tubular elements is made equal with respect to all telescopingly engaged portions.

Figure 5:
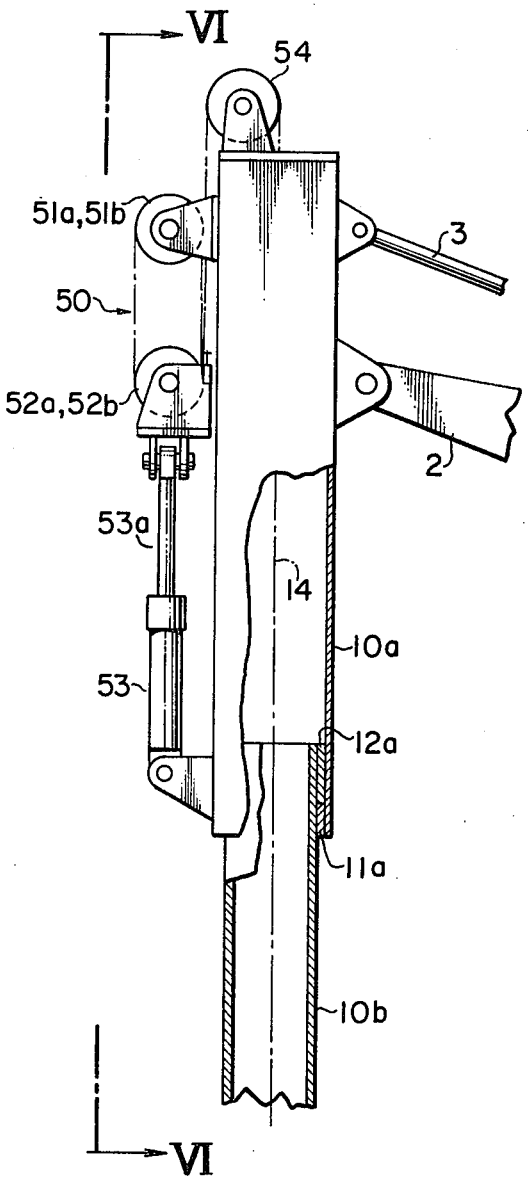
FIG. 5 is a diagrammatical illustration of a part of still another embodiment of the rod device of the present invention.

FIGS. 5 and 6 show a third embodiment of the present invention, which is a modification of the embodiment shown in FIGS. 1 and 2, with respect to the cable winding up device. In this embodiment, the root end portion of the cable 14 is incorporated in a sheave system 50 having stationery pulleys 51*a*, 51*b*, and movable pulleys 52*a*, 52*b*, the latter being supported by a cylinder-piston actuator 53. Member 54 is a guide pulley which changes the direction of the cable 14 by an angle of about 180°. The sheave system 50 is of a well-known type which is often used to magnify axial movement of a cable so that, for example, a relatively large lift is available by a relatively small stroke of a cylinder-piston actuator. Also in this embodiment, a relatively large axial movement of the cable 14 required at its tip end for expanding or contracting the telescoped tubular elements 10*a*–10*n* is generated by the reciprocating movement of the piston rod 53*a* within a relatively small stroke. In FIGS. 5 and 6, the portions corresponding to those shown in FIG. 1 are designated by the same reference numerals.

Figure 8:
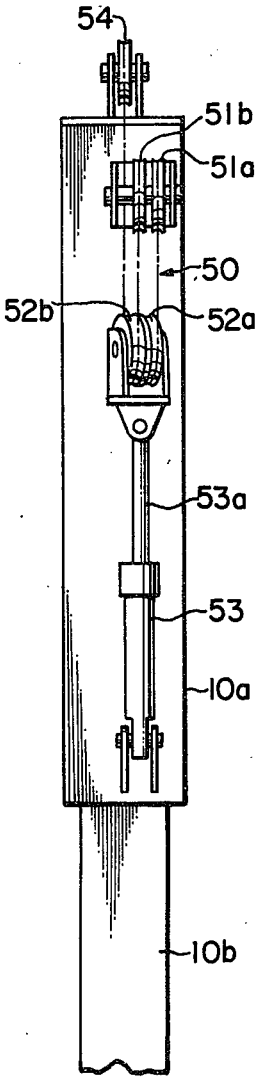
FIG. 8 is a side view of the device shown in FIG. 7, seen in the direction of arrows VIII—VIII.
Figure 7:
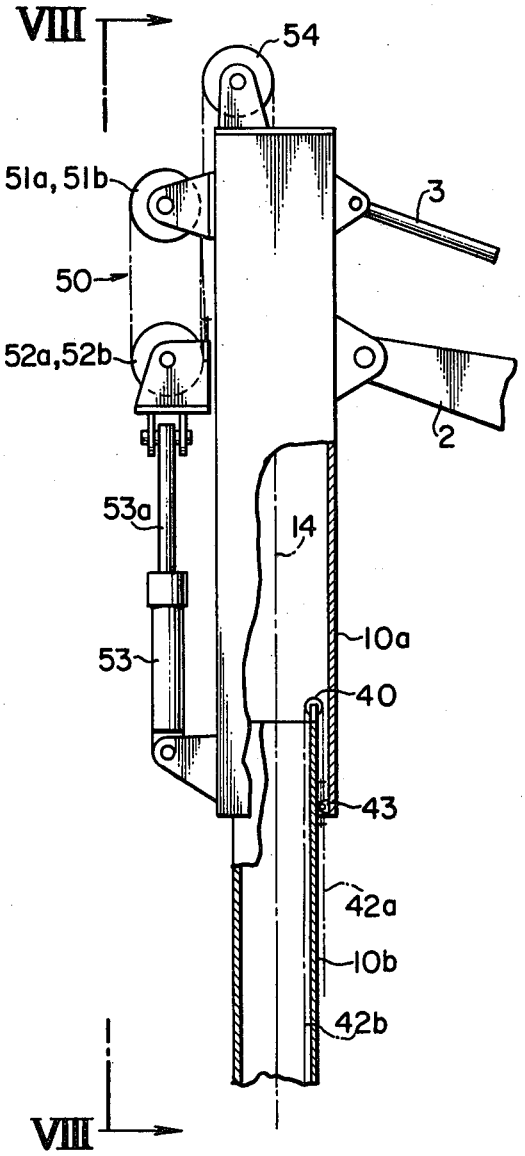
FIG. 7 is a view similar to FIG. 5, showing still another embodiment of the rod device of the present invention.

FIGS. 7 and 8 are views similar to FIGS. 5 and 6, respectively, showing a modification of the embodiment shown in FIG. 3 in the same manner as the embodiment shown in FIGS. 5 and 6 is modified from the embodiment shown in FIG. 1. Therefore, in order to avoid repeated explanations, the portions in the embodiment shown in FIGS. 7 and 8 corresponding to those shown in FIGS. 3, 5, and 6 are designated by the same reference numerals and detailed explanations will be omitted.

Figure 9:
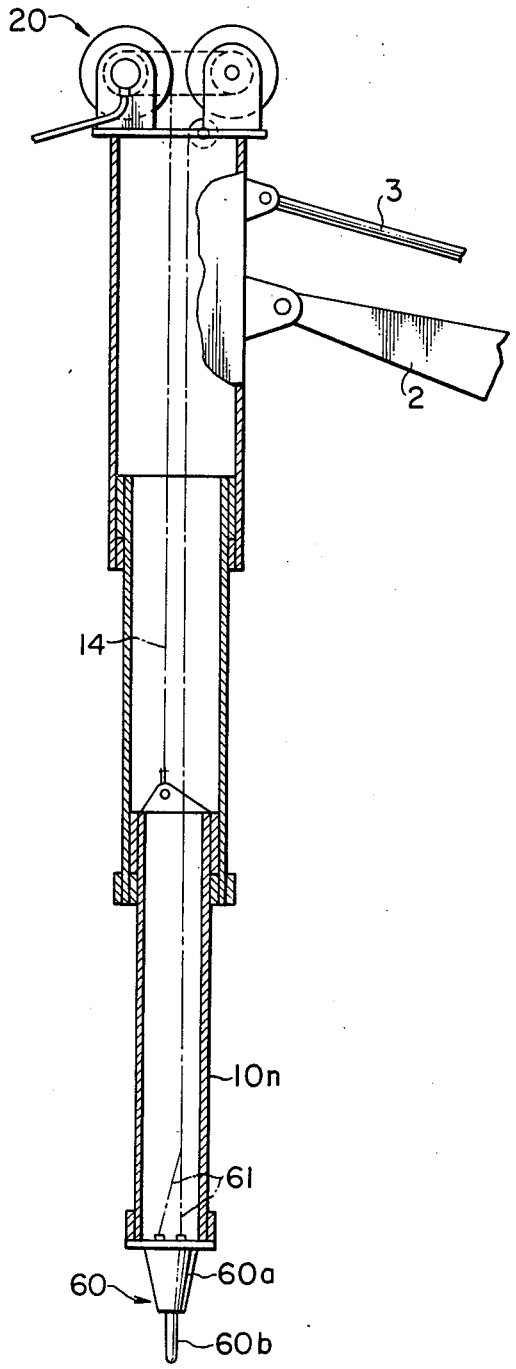
FIG. 9 is a diagrammatical illustration of a rod device similar to that shown in FIG. 1, supporting a rock breaker as an excavating head.

FIG. 9 shows a rod device similar to that shown in FIG. 1, which, however, supports a rock breaker 60 instead of a clamshell bucket. The rock breaker 60 is of an oil pressure type or a pneumatic type having a body 60*a* incorporating a vibrator (not shown) and a hammer 60*b*. The body 60*a* is directly mounted to the tip end of the innermost tubular element 10*n*. A pair of hoses 61 for supplying hydraulic oil or pneumatic pressure for operating the rock breaker are mounted in the central bore of the rod device. In FIG. 9, the portions corresponding to those shown in FIG. 1 are designated by the same reference numerals as in FIG. 1, and operate in the same manner as those in the embodiment shown in FIG. 1. Therefore, in order to avoid useless repetition of explanation, a detailed explanation with respect to those common portions will be omitted.

However, one point to be particularly noted with respect to this embodiment is that rock breaking operation is automatically and more effectively proceeded by employing this device because not only the reaction in rock breaking is well supported but also breaker feeding action is given by the weight of the innermost tubular element 10*n*, and it is only necessary to properly pay out the cable 14 and the hoses 61 by maintaining a slight surplus.

Figure 10:
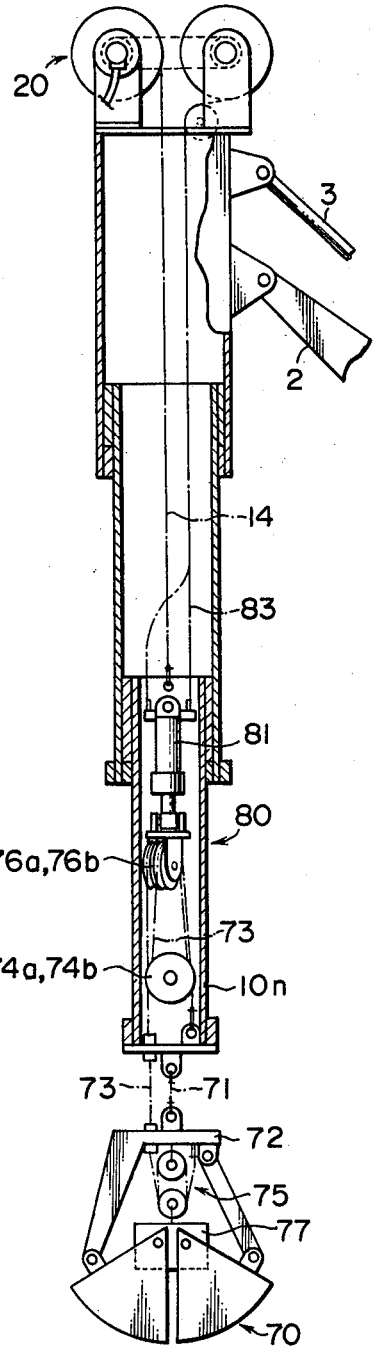
FIG. 10 is a diagrammatical illustration of still another embodiment of the rod device of the present invention, incorporating a sheave system for operating a clamshell bucket.
Figure 11:
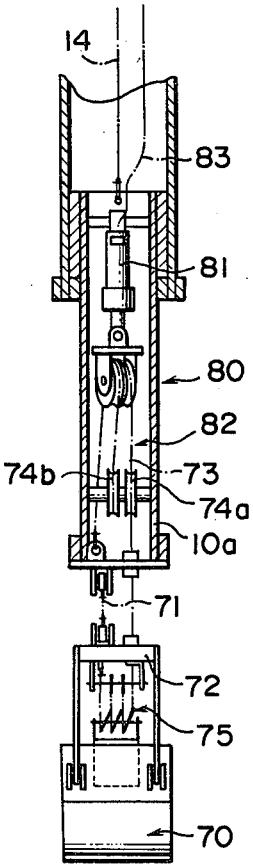
FIG. 11 is a diagrammatical illustration of a part of the device shown in FIG. 10, by a sectional plane shifted by 90° from that for FIG. 10.

FIGS. 10 and 11 show still another embodiment, in which the structure of the telescoping tubular elements is similar to that of the embodiment shown in FIG. 1, but a sheave system for operating a clamshell bucket is incorporated at the inside of the innermost tubular element 10*n*. At the tip end of the tubular element 10*n* is mounted a clamshell bucket 70 by a cable 71. The clamshell bucket 70 has a frame 72 in which is incorporated a sheave system 75 for opening and closing the clamshell bucket. A clamshell bucket of this type which is opened or closed by a sheave system is well known in the art. Member 73 designates a cable, one end portion of which is incorporated in the sheave system 75 while the other end portion of the cable is incorporated in the sheave system, designated by 80, incorporated in the innermost tubular element 10*n*. The sheave system 80 includes stationary pulleys 74*a*, 74*b*, and movable pulleys 76*a*, 76*b*, which are supported by an oil pressure actuator 81. In the sheave system 80 the cable 73 extended from the sheave system 75 is first guided by the roller 74*a* toward the roller 76*a*, and then the cable is engaged around the pulleys 76*a*, 74*b*, and 76*b* in this order, and it is finally fixed to the tip end portion of the tubular element 10*n*. This sheave system has a function of magnifying axial movement of the cable relative to the movement of the movable pulleys, which, in this case, correspond to the stroke of the actuator 81. A pair of oil pressure conducting hoses 83 are connected to the actuator 81 so as to selectively reciprocate it. As apparent from the shown structure, when the movable pulleys 76*a*, 76*b* are pulled upward by the actuator 81, the cable 73 is tightened and the clamshell bucket 70 is closed. By contrast, when the movable pulleys 76*a*, 76*b* are lowered by the actuator 81, the cable 73 is loosened so that the clamshell bucket 70 is opened by the action of a weight incorporated in a bearing block 77.

Other portions in the embodiment shown in FIGS. 10 and 11 are similar to those in the embodiment shown in FIGS. 1 and 2. Therefore, in FIGS. 10 and 11 the portions corresponding to those shown in FIGS. 1 and 2 are designated by the same reference numerals as in FIGS. 1 and 2, and detailed explanations will be omitted in order to avoid repeated explanation.

Figure 13:
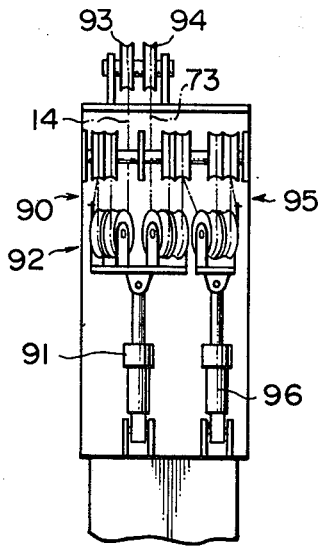
FIG. 13 is a side view of the device shown in FIG. 12, seen in the direction of arrows XIII—XIII.
Figure 12:
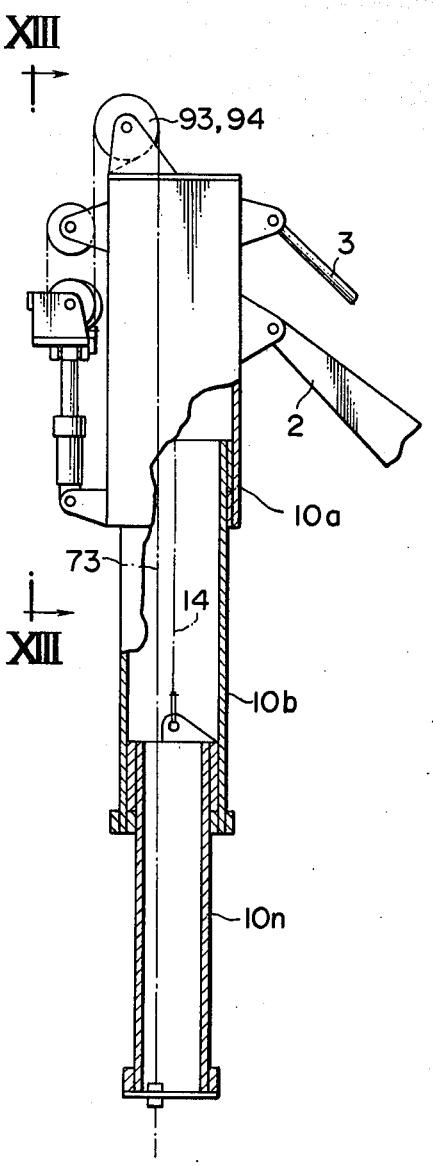
FIG. 12 is a diagrammatical illustration of still another embodiment of the present invention, incorporating sheave systems for descending and ascending and for opening and closing a clamshell bucket.

FIGS. 12 and 13 show still another embodiment of the present invention, in which sheave systems for expanding and contracting the telescoping tubular elements and for opening and closing a clamshell bucket are mounted at the outside of the outermost tubular element 10*a*. In this case, although not shown in the figure, a clamshell bucket of the sheave operating type such as shown in FIG. 10 is connected to the tip end of the tubular element 10*n*. The clamshell bucket is adapted to be opened or closed by a cable 73. Expansion and contraction of the telescoping tubular elements 10*a*–10*n* is effected by the cable 14.

Figure 14:
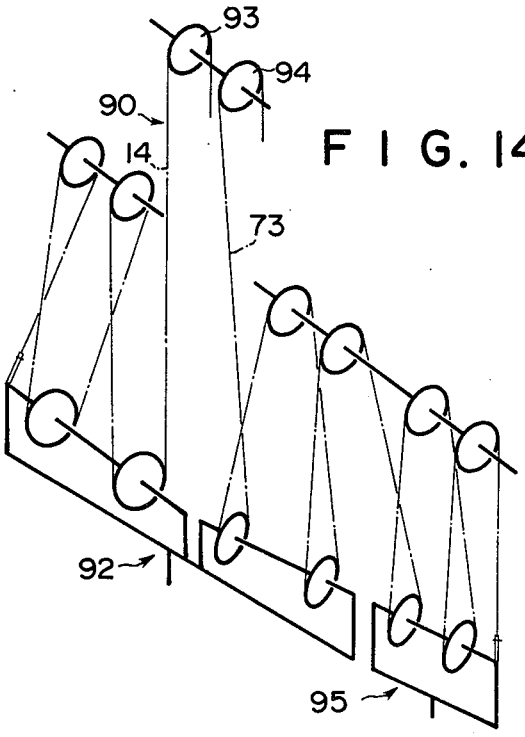
FIG. 14 is a diagrammatical perspective view showing the sheave systems incorporated in the device shown in FIGS. 12 and 13.

The sheave system generally designated by 90 includes a first sheave system 92 which incorporates both the cables 14 and 73 and a second sheave system 95 which incorporates only the cable 73. The first sheave system 92 is operated by an oil pressure actuator 91, while the second sheave system 95 is operated by an oil pressure actuator 96. At the root end portion of the outermost tubular element 10*a* the cable 14 and 73 are guided by pulleys 93 and 94, respectively, so as to change their direction by an angle of about 180°. The arrangement of the cables 14 and 73 in the sheave systems 92 and 97 will be apparent from FIG. 14 which is a diagrammatical perspective view of these two sheave systems in somewhat developed condition. A sheave system of this type itself and its operation are well known in the art. Only a point to be particularly noted in this embodiment is that axial movement of the tip end of the clamshell bucket operating cable 73, which must be the addition of its shifting for opening or closing the clamshell bucket and its shifting for compensating for expansion or contraction of the rod device, is automatically attained by the cable 73 being processed in the same manner as the cable 14 by the sheave system 92, so that the axial shifting of the cable 73 relative to the cable 14 or the clamshell bucket suspended by the cable 14 is exactly controlled by the sheave system 95 or the actuator 96 which operates this sheave sysstem. In FIGS. 12 and 13, the portions corresponding to those shown in FIGS. 1 and 2 are designated by the same reference numerals.

Figure 16:
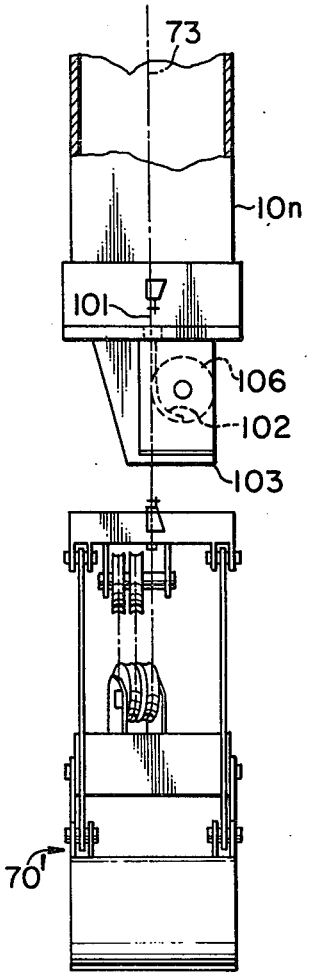
FIG. 16 is a side view of the device shown in FIG. 15, seen in the direction of arrows XVI—XVI.
Figure 15:
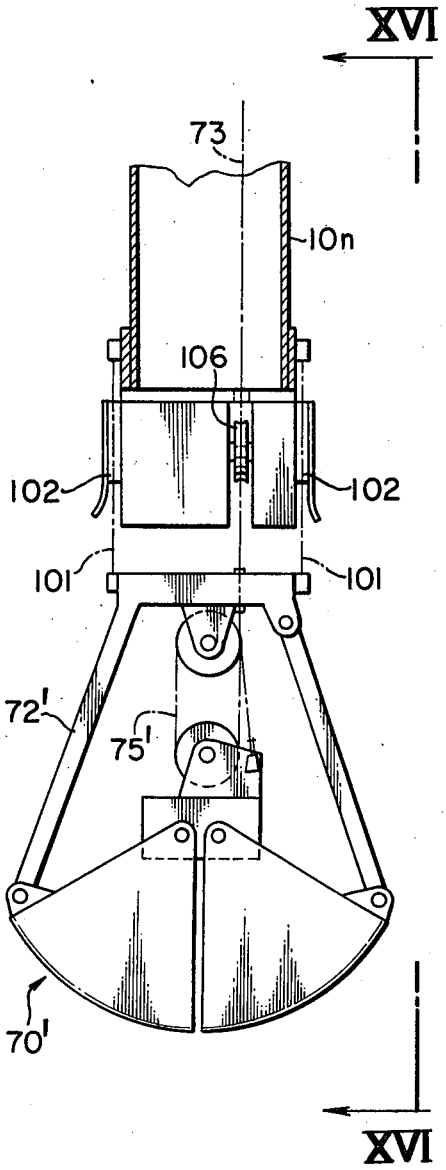
FIG. 15 is a diagrammatical illustration of the tip end portion of still another embodiment of the rod device of the present invention, with a clamshell bucket supported by the rod device.

FIGS. 15 and 16 show a modification of the clamshell bucket suspending structure shown in FIGS. 10 and 11. In this modification, the clamshell bucket 70' is of a cable operating type similar to the clamshell bucket 70 shown in FIGS. 10 and 11. In this modification, the frame 72' of the clamshell bucket is suspended by a pair of cables 101 from the tip end of the innermost tubular element 10*n*. Said tip end has a pair of accurately curved guide elements 102 located so as to contact one side of the cables 101. Further, a guide pulley 106 is rotatably mounted at said tip end with part of its peripheral surface substantially in coincidance with the accurately curved outer surface of the guide element 102 when viewed in the direction of the central axis of the pulley 106. As shown in FIG. 16, when the tubular element 10*n* is held perpendicularly, the cables 101 are just in contact with the outer guiding surface of the guide elements 102 without being bent by them, while the cable 73, a part of which is incorporated in the sheave system 75' for opening or closing the clamshell bucket, is also just in contact withh an outer peripheral portion of the guide pulley 106 without being bent by it. By this arrangement, when the tubular element 10*n* is inclined clockwise as viewed in FIG. 16, the cables 101 and 73 are smoothly guided around the guide elements 102 and the guide pulley 106, respectively, whereby suspension of the clamshell bucket in its opened or closed condition is stably maintained in spite of such inclination of the innermost tubular element 10*n*. In this case, it is of course necessary that the length of the cables 101 (also the corresponding portion of the cable 73) should be determined so as not to cause any interference between the frame 72' and the tip edge portion 103.

Figure 18:
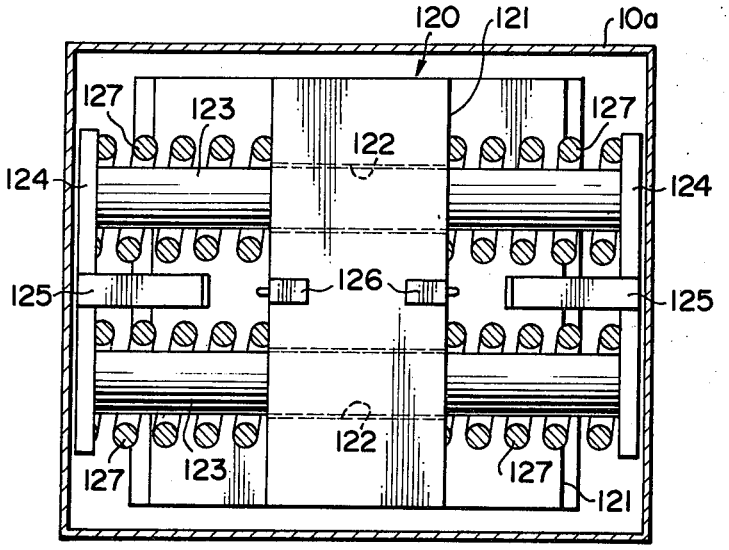
FIG. 18 is a diagrammatical view of the device shown in FIG. 17, seen in the direction of arrows XVIII—XVIII.
Figure 17:
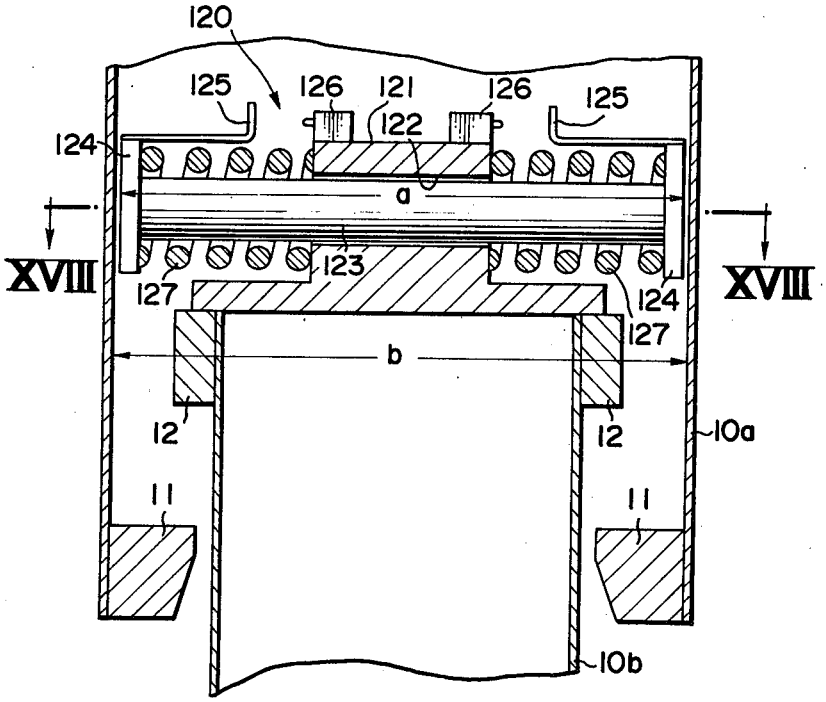
FIG. 17 is a diagrammatical longitudinal sectional view showing a moment limiter, which may be incorporated in the rod device of the present invention.

FIG. 17 is a partial sectional view, somewhat enlarged as compared with FIG. 1, etc., of the telescoping part of an embodiment of the rod device of the present invention, in which a means generally designated by 120 is incorporated, which detects transverse load applied to an end portion of a first tubular element, such as 10*b*, inserted into a second tubular element, such as 10*a*, relative to the second tubular element, thereby detecting moment exerted to the rod device, and operates to suppress the moment within an allowable limit. FIG. 18 is a cross sectional view along line XVIII—XVIII in FIG. 17. The moment limiter 120 includes a bearing member 121 mounted to the root end of the tubular element 10*b*. In the shown embodiment, the bearing member 121 has a pair of bearing openings 122 extending traversely with respect to the longitudinal axis of the tubular element 10*b*, and slidably supports a pair of rod members 123 engaged in the transverse openings 122. Opposite ends of one rod member 123 are connected with the corresponding opposite ends of the other rod member 123 by connecting members 124. Each connecting member supports a lug member 125 at a middle portion thereof. As opposed to the lug members 125 so as to be actuated by these lug members when the rod members 123 shift relative to their bearing member 121 in either direction beyond a predetermined distance, a pair of limit switches 126 are provided as mounted to the bearing member. Around the rod members 123, as disposed between the central projection of the bearing member 121 and the connecting members 124, are provided four compression coil springs 127 each having a predetermined spring constant. The dimension "a" between the outside surfaces of the connecting members 124 is slightly smaller than the dimension "b" between the inside surfaces of the opposite wall portions of the tubular element 10*a*, so as to allow the assembly of the rod members 123 and the connecting members 124 to slide freely along the opposite inside surfaces of the tubular element 10*a*. Further, a substantial transverse clearance is left between the stop 12 mounted at the outside of the root end portion of the tubular element 10*b* and the inside surface of the tubular element 10*a*.

By a moment limiter as explained above being incorporated in the telescoping portion of the rod device, when a moment beyond a predetermined value is exerted between the tubular elements 10*a* and 10*b*, i.e. to the rod device, so as to bend the tubular elements 10*a* and 10*b* along the plane of the sheet bearing FIG. 17, it is detected by one of the limit switches 126. Such exertion of over-loading moment to the rod device is generally caused by undue operation of the boom 2, the actuator 3, and/or the motor incorporated in the base structure 1*a* for rotating the upper base structure relative to the lower base structure. Therefore, if a safety device which automatically stops the operation of one or more of these rod device driving means in accordance with actuation of the limit switch 126, the rod device is saved from being damaged by over bend loading, particularly when it can bear a large tensile force but is rather susceptible to be damaged by bending force.

Further, the moment limiter, when it is provided so as to limit the moment exerted to the rod device along the plane which includes the central axis of the rod device and is perpendicular to the sheet bearing FIG. 1, also protects the pivoting structure which pivotally connects the boom and the rod device from being damaged by over transverse twisting. Although the abovementioned pivoting structure is designed to be strong enough so as to support such a transverse twisting when the rod device is contracted, when the rod device is extended, over rotation of the upper base structure, with the tip end of the rod device being engaged with some obstacle such as an edge of a hole excavated, will readily cause over transverse twisting of the pivoting structure. Such a danger is automatically avoided by the motor for rotating the upper base structure relative to the lower base structure being automatically stopped when the moment exerted to the rod device in the corresponding direction exceeds a predetermined value.

Figure 20:
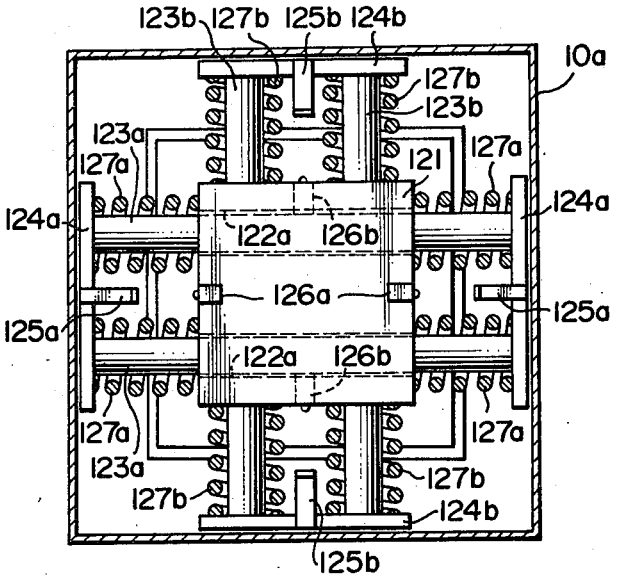
FIG. 20 is a diagrammatical view of the device shown in FIG. 19, seen in the direction of arrows XX—XX.
Figure 19:
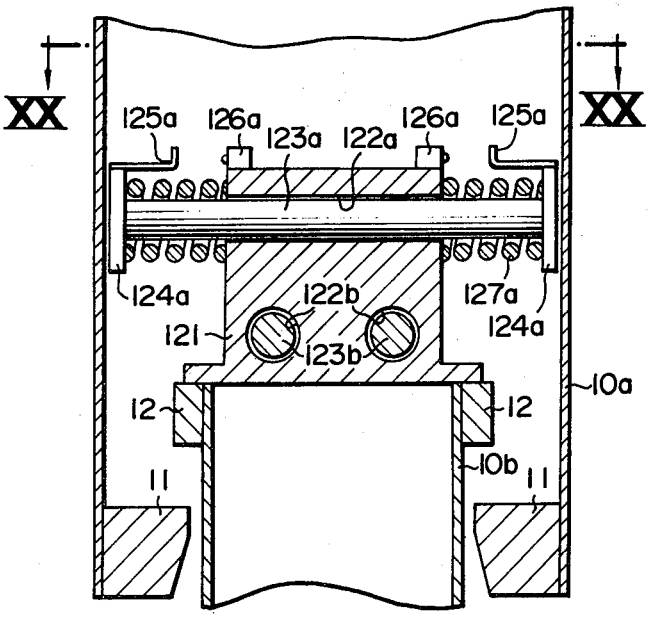
FIG. 19 is a view similar to FIG. 18, showing another modification of the moment limiter.

FIGS. 19 and 20 are views similar to FIGS. 17 and 18, respectively, showing another embodiment of the moment limiter for the root end of a tubular element inserted into another tubular element. The moment limiter shown in FIGS. 18 and 20 is substantially a duplication of the moment limiter shown in FIGS. 17 and 18. Therefore, in FIGS. 19 and 20 one set of the portions corresponding to those shown in FIGS. 17 and 18 are designated by the corresponding reference numerals which, however, are attached with "a", while the other set of portions corresponding to those shown in FIGS. 17 and 18 are designated by the corresponding reference numerals attached with "b", except the bearing member 121, which is common to the two sets of assemblies.

It will be apparent from comparison of the structure shown in FIGS. 17 and 18 with that of FIGS. 19 and 20 that, in the structure shown in FIGS. 17 and 18 the moment to bend the rod device along only one plane is detected so as to be limited within a predetermined value, while in the structure shown in FIGS. 19 and 20 the moments to bend the rod device along two vertically crossing planes are detected so as to be limited within a predetermined value.

Figure 21:
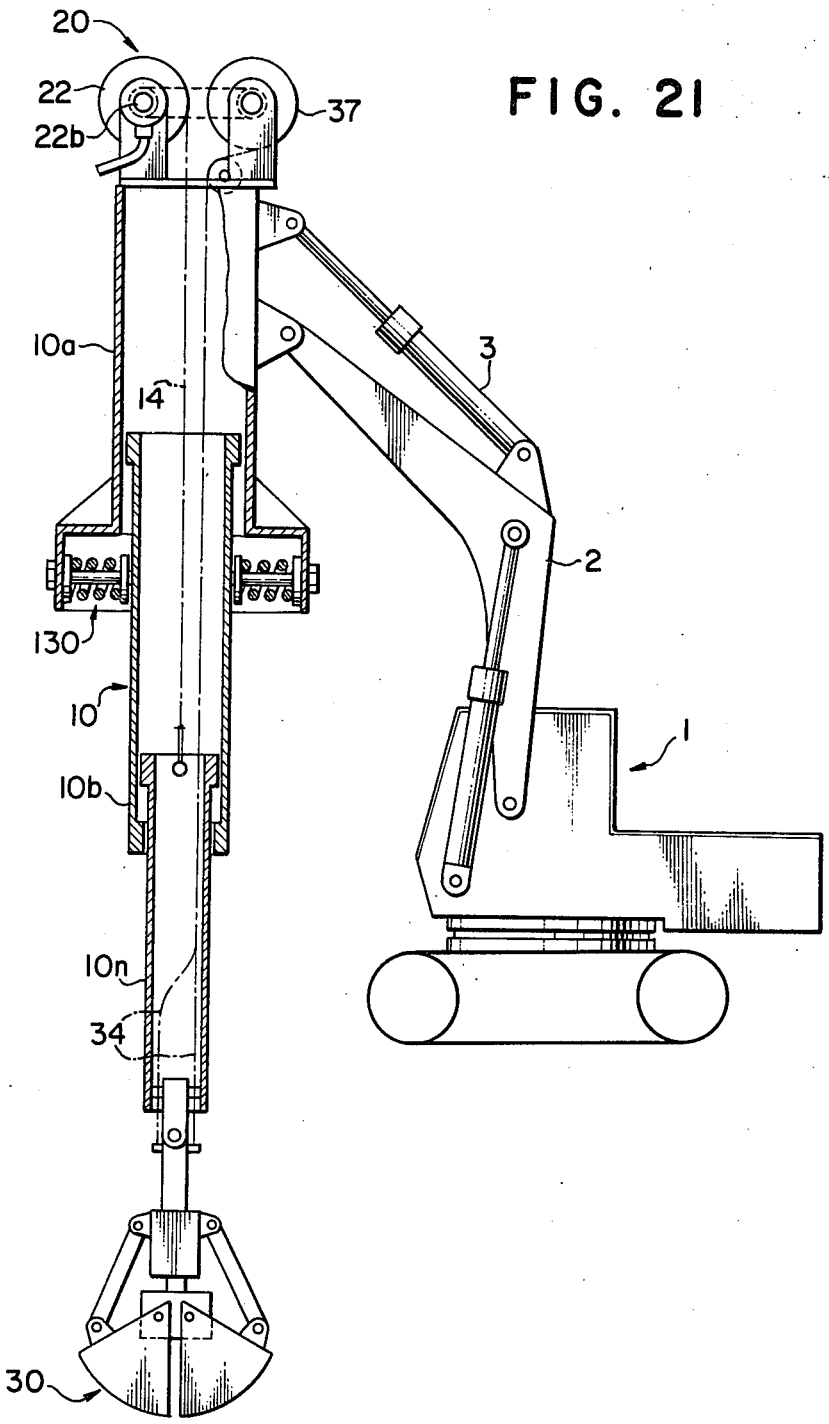
FIG. 21 is a diagrammatical illustration of still another embodiment of the rod device of the present invention, incorporating a moment limiter.

FIG. 21 shows still another embodiment of the rod device of the present invention, which is substantially a modification of the rod device shown in FIGS. 1 and 2, such as to incorporate a moment limiter 130. In FIG. 21, the portions corresponding to those shown in FIG. 1 are designated by the same reference numerals as in FIG. 1.

Figure 22:
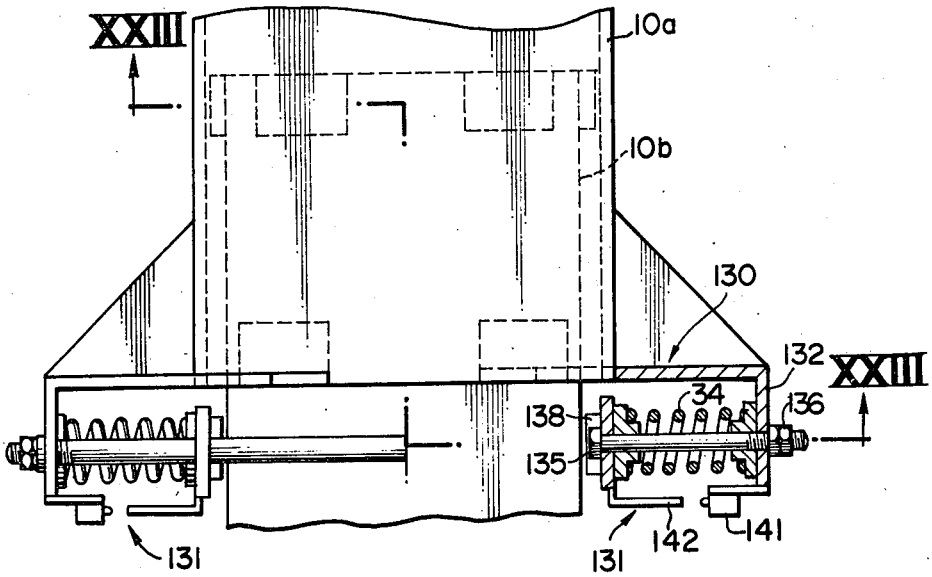
FIG. 22 is a view, showing the moment limiter shown in FIG. 21 in more detail.
Figure 23:
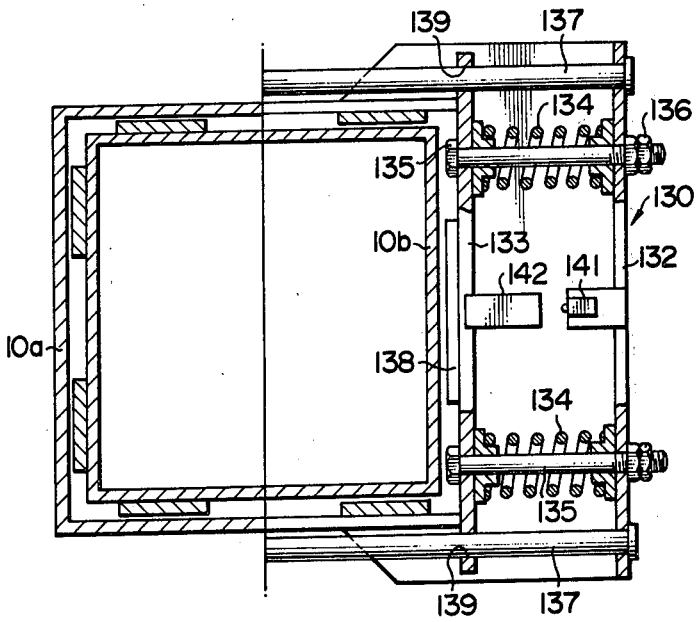
FIG. 23 is a sectional view along line XXIII—XXIII in FIG. 22.

FIGS. 22 and 23 show detailed structures of the moment limiter 130 incorporated in the rod device shown in FIG. 21. In this case, at opposite sides of the tip end portion of the outer tubular element 10*a* are mounted brackets 132 which individually support halves 131 of the moment limiter 130. For the simplicity of explanation, only one half of the member 131 of the moment limiter will be explained. A plate element 133 is slidably supported by a pair of bolts 135 which are also slidably supported by the bracket 132. The plate element 133 is biased by a predetermined spring force so as to depart from the bracket 132 by a pair of compression coil springs 134 each being mounted around each bolt 135. A slide element 138 is mounted to one side of the plate element 133 so as to face the outside surface of the tubular element 10*b*. The clearance between the slide element 138 and the tubular element 10*b* is adjusted by adjusting nuts 136 fastened onto the bolts 135.

The bracket 132 supports a limit switch 141 at a middle portion thereof, while the plate element 133 supports a lug member 142 arranged so as to actuate the limit switch when the plate element 133 is biased toward the bracket 132 as much as a predetermined amount. The brackets 132 are connected with each other by a pair of bolts 137, which also serve as guide means for the plate elements 133 which are engaged with the bolts 137 at their openings 139.

As compared with the moment limiter 120 shown in FIGS. 17 and 18, the moment limiter 130 shown in FIGS. 21, 22 and 23 has a feature that the limit value of moment to be detected by the limit switch is set at any desired high value even with a relatively small deflection of the two mutually telescoping tubular elements from their exactly aligned condition, because in this case the springs 134 can be optionally preloaded without being balanced by the springs incorporated in the other half 131 of the moment limiter. However, when smooth and relatively large flexibility is desired with respect to the rod device with a definite limiting of moment exerted, the moment limiter 120 may be more advantageous.

Further, the moment limiters 120 and 130 have different performances with respect to the relation between the limit value of moment detected and the depth of engagement between the two mutually telescoping tubular elements. Assuming that the tubular element 10*b* having the total length of Lt is inserted into the tubular element 10*a* with the depth of engagement of Ld, and that the limit switches 126 and 141 are actuated when the springs 127 and 134 are compressed by the force of f, respectively, the moment limiter 120 responds to transverse force applied to the tip end of the tubular element 10*b* which is $f \times Ld/(Lt-Ld)$, whereas the moment limiter 130 responds to same kind of force which is however $f \times Ld/Lt$. Therefore, the moment limiter 120 responds to quickly increasing transverse force as the depth of engagement increases, whereas the moment limiter 130 responds to moderately increasing force as the depth of engagement increases, which is $f \times 1$ at the highest and is definitely within the range detected by the moment limiter.

Figure 25:
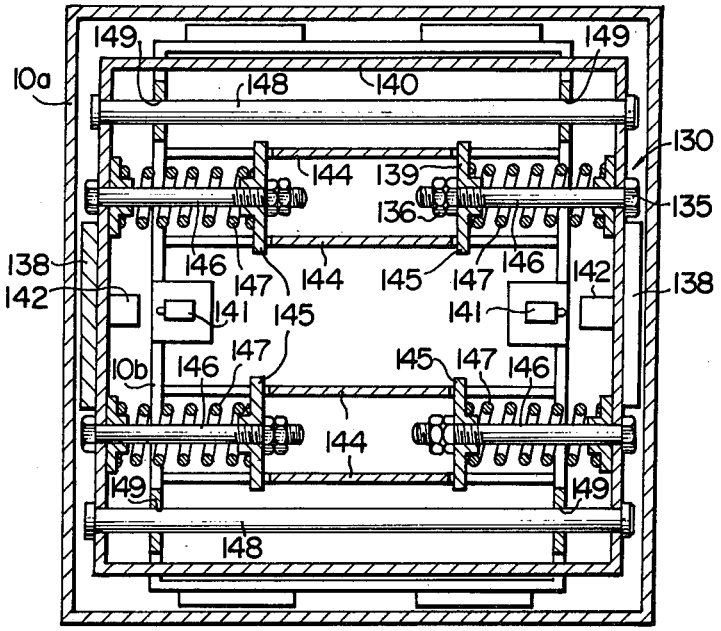
FIG. 25 is a diagrammatical cross sectional view of the device shown in FIG. 24, along line XXV—XXV.
Figure 24:
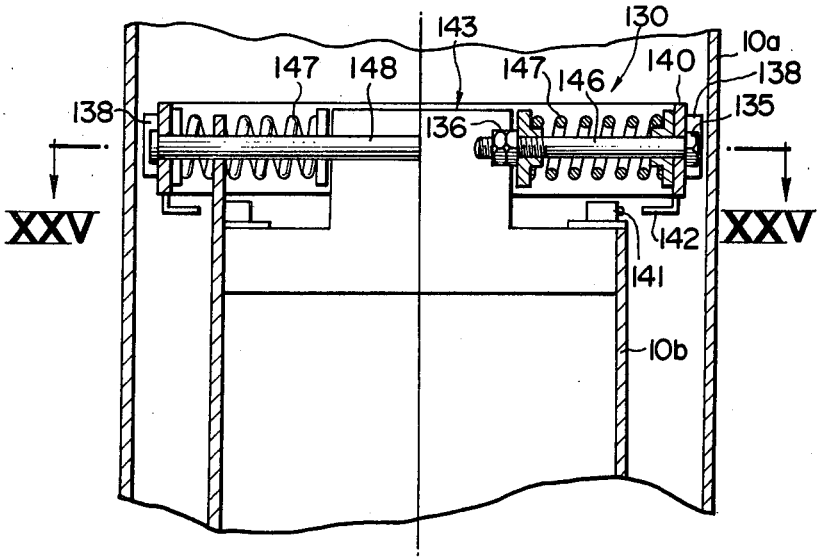
FIG. 24 is a diagrammatical longitudinal sectional view of another moment limiter.

FIGS. 24 and 25 show still another embodiment of the moment limiter. In this embodiment, a square ring element 140 is shiftably supported at the root end portion of the tubular element 10*b* from a support frame structure 143, which is formed of plate elements 144 and 145, by way of guide bolts 146 and compression coil springs 147. Also in this case, relative shifting between the outer and the inner tubular elements 10*a* and 10*b* is detected by the combination of limit switches 141 mounted to the tubular element 10*b* and lugs 142 mounted to the ring element 140. At the outside surface of the ring element are mounted slide elements 138 as opposed to the inside surface of the tubular element 10*a*. The ring element 140 is further slidably supported by a pair of bolts 148 mounted thereto being slidably. received in openings 149 formed at a root end portion of the tubular element 10*b*.

In this embodiment, the unit generally designated by 130, which includes spring 134, bolt 135 and nuts 136, is similar to the unit 130 included in the embodiment shown in FIGS. 22 and 23, and operates in the same manner as the former unit with respect to the optional preloading of a half set of springs 134 so that it is not affected by the preloading of the other half set of springs 134 which operate in the opposite direction.

Although the invention has been shown and described with respect to some preferred embodiments thereof, it should be understood that various changes and omissions of the form and detail thereof may be made therein by those skilled in the art without departing from the scope of the invention.

I claim:

1. An excavator comprising:

a base structure;

a boom pivotally attached to said base structure at a first end and having a second end;

an excavator head;

an excavator head supporting arm including;

a plurality of telescopic tubular elements including an outermost element, at least one intermediate element and an innermost element, the outermost element being pivotally mounted to said second end of said boom at substantially an intermediate portion thereof, said excavator head being mounted to said innermost element;

movement restricting means for limiting the relative axial movement between adjacent ones of said telescoping elements; and cable telescopic control means connected between said outermost element and innermost element of said plurality of tubular elements for controlling the axial extension of said excavator head supporting arm; and fluid pressure operated linear actuator means having relatively movable opposite ends for pivotally tilting said excavator head supporting arm with respect to said boom, one of said opposite ends being pivotally connected to substantially a middle portion of said boom while the other of said opposite ends is pivotally connected to a portion of said outermost tubular element substantially distant from the pivot point between said outermost tubular element and said second end of said boom towards the one end thereof being opposite to the other end thereof for supporting said excavator head; wherein said relative axial movement restricting means includes first and second pulleys mounted on said at least one intermediate element of said tubular elements adjacent its opposite ends, and first and second cables engaged around said two pulleys, said cables each being connected at their opposite ends with an end portion of adjacent tubular elements which engage with opposite ends of said at least one intermediate element.

2. The excavator according to claim 1, further comprising a means for detecting a predetermined maximum bending moment exerted between two of said tubular elements which are mutually engaged, said moment detecting means including a spring which is biased in accordance with transverse shifting between an end portion of one of said two tubular elements and a portion of the other of said two tubular elements which opposes said end portion of said one tubular element, and a limit switch which is actuated when said shifting reaches a predetermined value.

3. The excavator of claim 2, wherein said one tubular element is inserted, at its said end portin, into said other tubular element.

4. The excavator of claim 2, wherein said other tubular element is inserted into said end portion of said one tubular element.

5. The excavator of claim 2, wherein said spring is a compression spring which is compressed to a greater extent as said shifting increases, said moment detecting means further including a means for restricting expansion of said compression spring beyond a predetermined length.

6. The excavator according to claim 1, further comprising a drum for winding up a cable of said cable telescopic control means and a motor driving said drum, both being mounted on the outermost tubular element.

7. The excavator according to claim 1, further comprising a first sheave system and a first oil pressure actuator, both being mounted on the outermost tubular element, said cable telescopic control means being adapted to be driven by said first actuator by way of said first sheave system.

8. The excavator of claim 7, wherein said excavator head is a clamshell bucket; said excavator further comprising a second sheave system and a second oil pressure actuator, both being mounted on the outermost tubular element and adapted to handle a cable for opening and closing said clamshell bucket which is used as mounted to the excavator, said first sheave system and said first oil pressure actuator being adapted also to operate the cable for opening and closing said clamshell bucket to compensate for changes in the length of said excavator head supporting arm.

9. The excavator according to claim 1, wherein said excavator head is a clamshell bucket; said excavator further comprising a sheave system and a fluid actuator for operating said clamshell bucket to be mounted to the tip end of the innermost tubular element, said sheave system and said actuator being mounted in the innermost tubular element.

* * * * *